US010900499B2

(12) United States Patent
Martin et al.

(10) Patent No.: US 10,900,499 B2
(45) Date of Patent: Jan. 26, 2021

(54) COOLING FANS FOR ENGINE COOLING SYSTEM

(71) Applicant: Ford Global Technologies, LLC, Dearborn, MI (US)

(72) Inventors: Douglas Martin, Canton, MI (US); Kenneth Miller, Canton, MI (US); Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 397 days.

(21) Appl. No.: 15/828,650

(22) Filed: Dec. 1, 2017

(65) Prior Publication Data

US 2018/0223876 A1 Aug. 9, 2018

Related U.S. Application Data

(60) Provisional application No. 62/455,461, filed on Feb. 6, 2017.

(51) Int. Cl.

| | |
|---|---|
| ***F04F 5/16*** | (2006.01) |
| ***F01P 5/02*** | (2006.01) |
| ***F04F 5/46*** | (2006.01) |
| ***F01P 11/12*** | (2006.01) |

(Continued)

(52) U.S. Cl.

CPC ..... *F04F 5/16* (2013.01); *F01P 5/02* (2013.01); *F01P 11/12* (2013.01); *F04D 25/08* (2013.01); *F04F 5/46* (2013.01); *F01P 2001/005* (2013.01)

(58) Field of Classification Search

CPC ..... F04F 5/16; F04F 5/46; F01P 11/12; F01P 5/02; F01P 2001/005; F01P 2005/025; F04D 25/08; F04D 29/665

See application file for complete search history.

(56) References Cited

U.S. PATENT DOCUMENTS 4,076,072 A * 2/1978 Bentz ..... F01P 3/18 165/41
4,589,379 A * 5/1986 Fujikawa ..... F01P 5/06 123/41.49

(Continued)

FOREIGN PATENT DOCUMENTS

GB 2280021 A * 1/1995 ..... F01P 5/02
JP 2014015862 A * 1/2014 ..... F01P 5/06

OTHER PUBLICATIONS

Strickland, J et al., "How the Dyson Bladeless Fan Works," How Stuff Works Website, Available at https://electronics.howstuffworks.com/gadgets/home/dyson-bladeless-fan.htm/printable, Oct. 26, 2009, 5 pages.

*Primary Examiner* — Hung Q Nguyen
(74) *Attorney, Agent, or Firm* — Geoffrey Brumbaugh McCoy Russell LLP

(57) ABSTRACT

Systems and methods are provided for a bladeless radiator cooling fan. In one example, a system may include a plurality of bladeless entrainment discs surrounded by a shroud, each bladeless entrainment disc including a hollow central opening that enables unrestricted ambient airflow through the cooling fan, and a source fan for providing airflow to the bladeless entrainment that is encased by a housing. In this way, airflow through the bladeless radiator cooling fan may be increased, decreasing powered fan usage and decreasing fan noise.

4 Claims, 9 Drawing Sheets

(51) Int. Cl.
*F04D 25/08* (2006.01)
*F01P 1/00* (2006.01)

(56) References Cited

U.S. PATENT DOCUMENTS

| | | | | |
|---|---|---|---|---|
| 4,825,815 | A * | 5/1989 | Turner | B60K 11/04 123/41.49 |
| 8,308,445 | B2 | 11/2012 | Gammack et al. | |
| 8,403,650 | B2 | 3/2013 | Gammack et al. | |
| 9,249,810 | B2 | 2/2016 | Gammack et al. | |
| 2013/0340459 | A1* | 12/2013 | Pomme | B64D 13/08 62/238.6 |
| 2019/0135084 | A1* | 5/2019 | Sato | F01P 3/18 |

* cited by examiner

COOLING FANS FOR ENGINE COOLING SYSTEM

CROSS REFERENCE TO RELATED APPLICATION

The present application claims priority to U.S. Provisional Patent Application No. 62/455,461 entitled "Cooling Fans for Engine Cooling System," filed on Feb. 6, 2017. The entire contents of the above-referenced application are hereby incorporated by reference in their entirety for all purposes.

TECHNICAL FIELD

The present application relates to cooling fans that may be used in a vehicle cooling system.

BACKGROUND AND SUMMARY

Vehicle cooling systems may include various cooling components such as radiators, cooling fans and blowers, condensers, liquid coolant, etc. An electrically driven engine cooling fan may be powered by an electric motor that is either variable speed or relay controlled. The cooling fan enables engine temperatures to be maintained in a target range. When engine temperatures (or engine coolant temperatures) exceed the target range, the cooling fan is operated to increase airflow through the engine, which carries the excess heat away to the outside air. The cooling fan is typically located in the engine compartment, at the front or rear of the radiator. As the cooling fan operates to direct air to the engine, the cooling air flows through radiator, also cooling the coolant.

The inventors herein have recognized various issues with cooling fans. As one example, cooling fans may be very noisy, especially when operated at high flow settings. The noise may be objectionable to vehicle customers. In particular, customers of luxury vehicles may demand quieter fan operation. As another example, cooling fans may reduce fuel economy. Although cooling fans are not on for a significant portion of a drive cycle, the blades and shrouds of the fan may continue to create a slight restriction, which reduces fuel economy and reduces airflow to the engine compartment. As yet another example, the location of the cooling fans relative to the radiator may make it difficult for a person (e.g., a service technician) to reach toward the radiator when the engine is running (e.g., during a service or cleaning procedure). Furthermore, the cooling fans may be inefficient.

In one example, the above issues may be addressed by an engine cooling system including a bladeless cooling fan. In one example, a system comprises: a plurality of bladeless entrainment discs surrounded by a shroud, the shroud coupled to a radiator and positioned between the radiator and an engine; a hollow central opening within each bladeless entrainment disc that enables unrestricted ambient airflow through the cooling fan; and a source fan for providing airflow to the bladeless entrainment discs, the source fan encased by a housing. In this way, a cooling fan with reduced noise and higher performance characteristics may be provided.

As one example, a Helmholtz resonator may be included within the housing, such as positioned adjacent to the source fan. By using a source fan that is coupled to a Helmholtz resonator, the efficiency of the fan is increased while using a lower power source fan. The lower power requirement of the fan reduces the noise output by the fan while consuming less engine power. By using a bladeless source fan, the noise output by the fan is reduced, as well as efficiency losses associated with flow restriction caused by fan blades. In addition, a service technician may be able to conveniently reach into the engine compartment while the fan is running.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
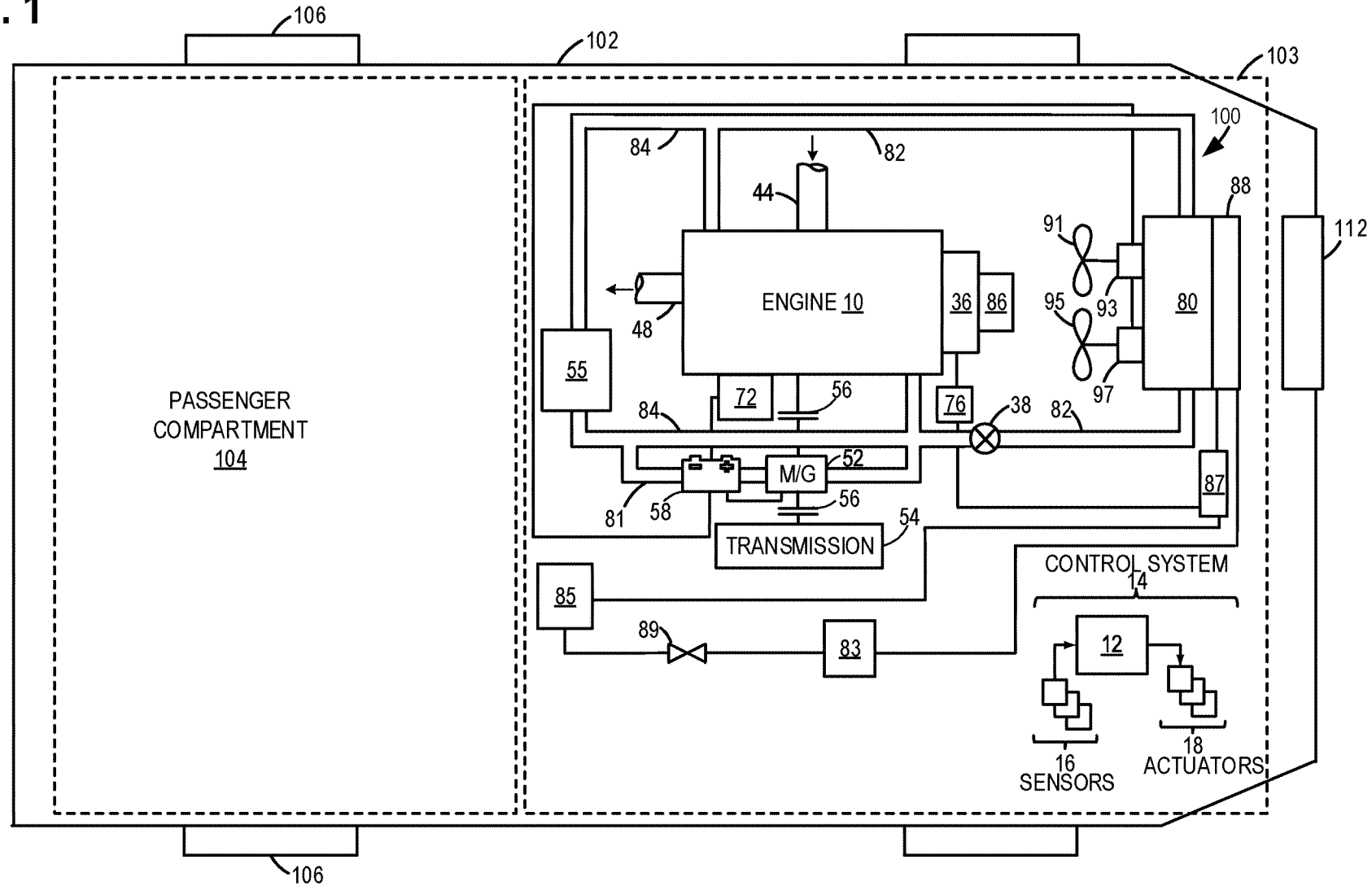
FIG. 1 portrays a schematic diagram of a cooling system in a motor vehicle.
Figure 2:
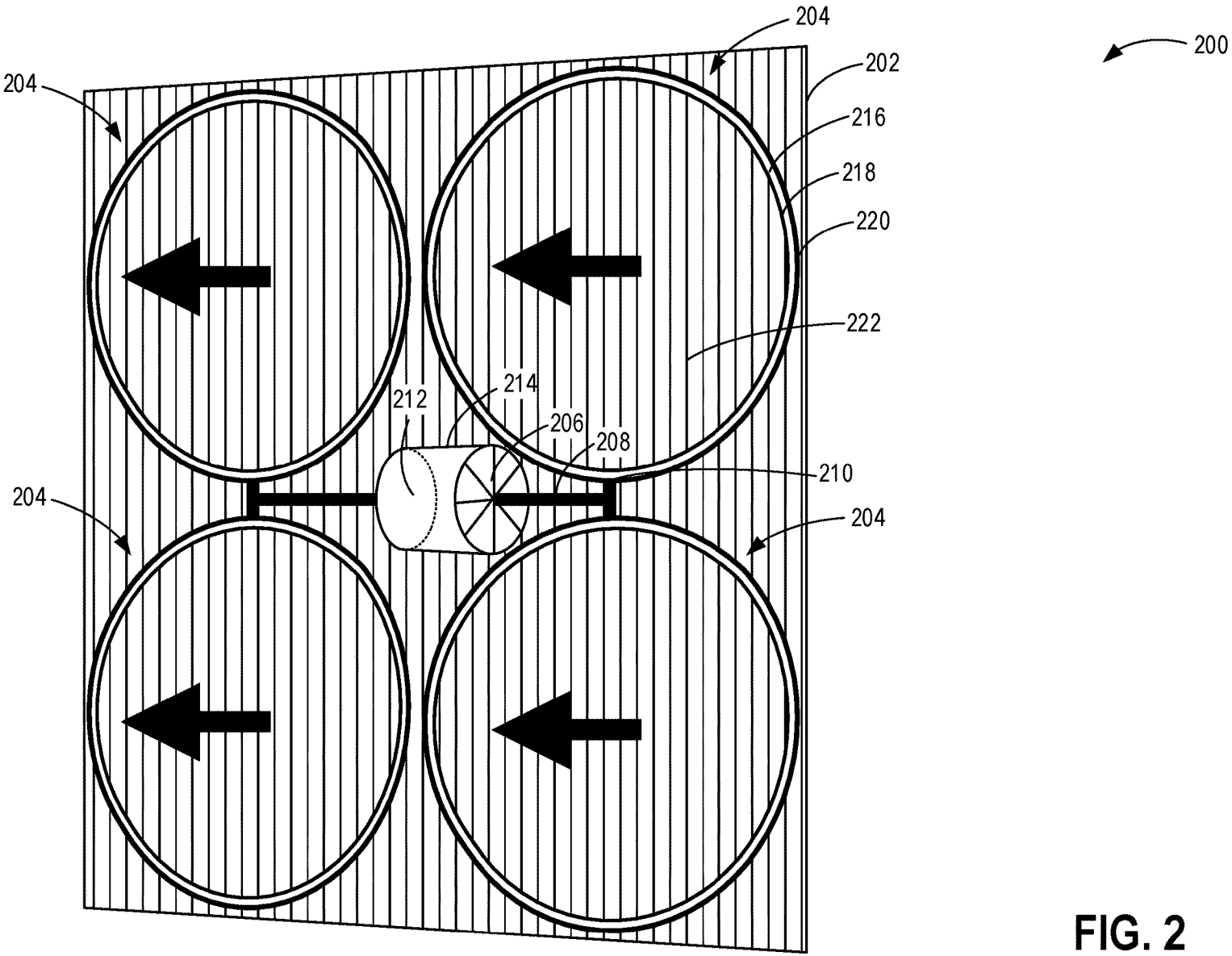
FIG. 2 depicts a first example of a bladeless fan of the cooling system of FIG. 1.
Figure 3:
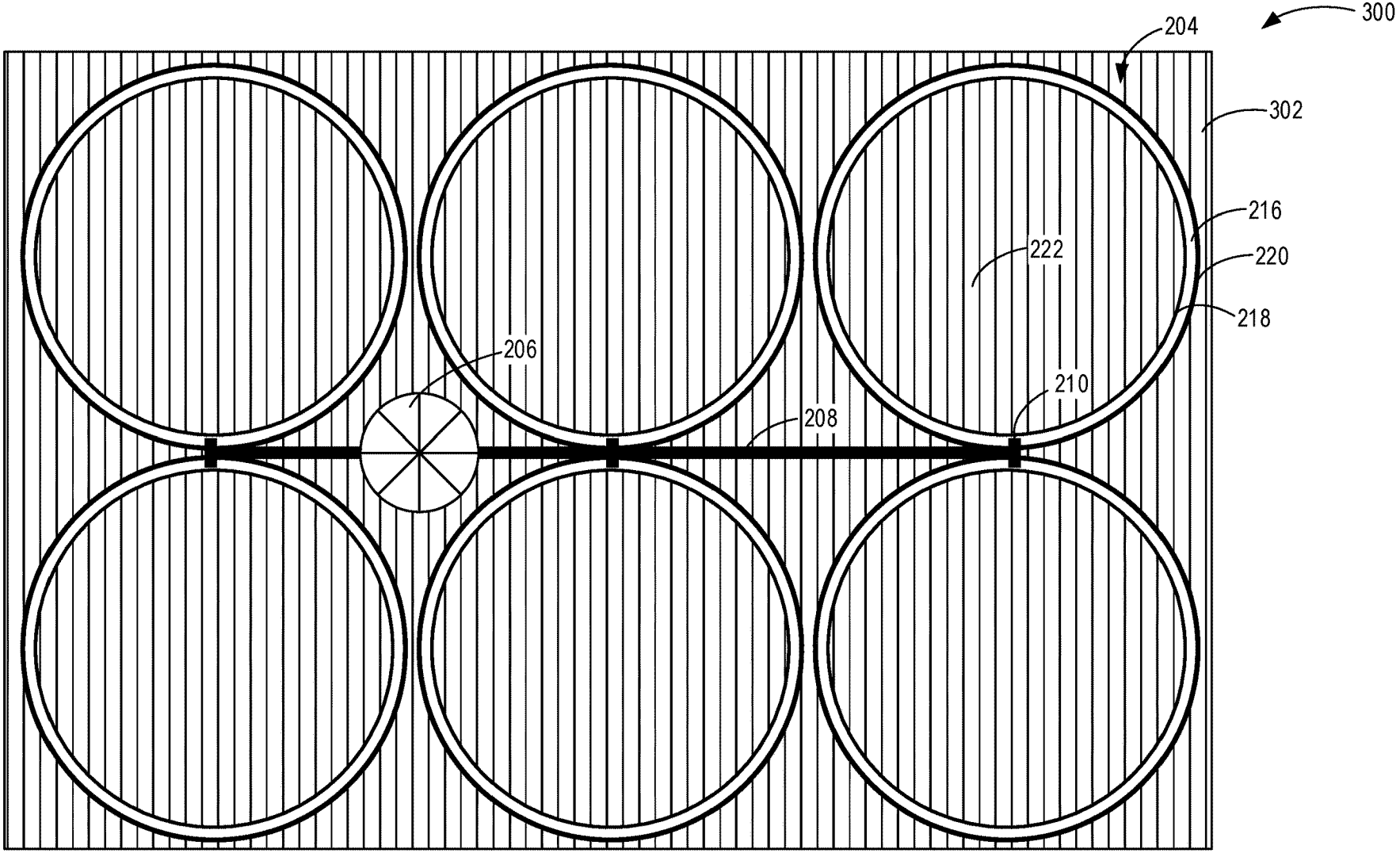
FIG. 3 depicts a second example of a bladeless fan of the cooling system of FIG. 1.
Figure 4:
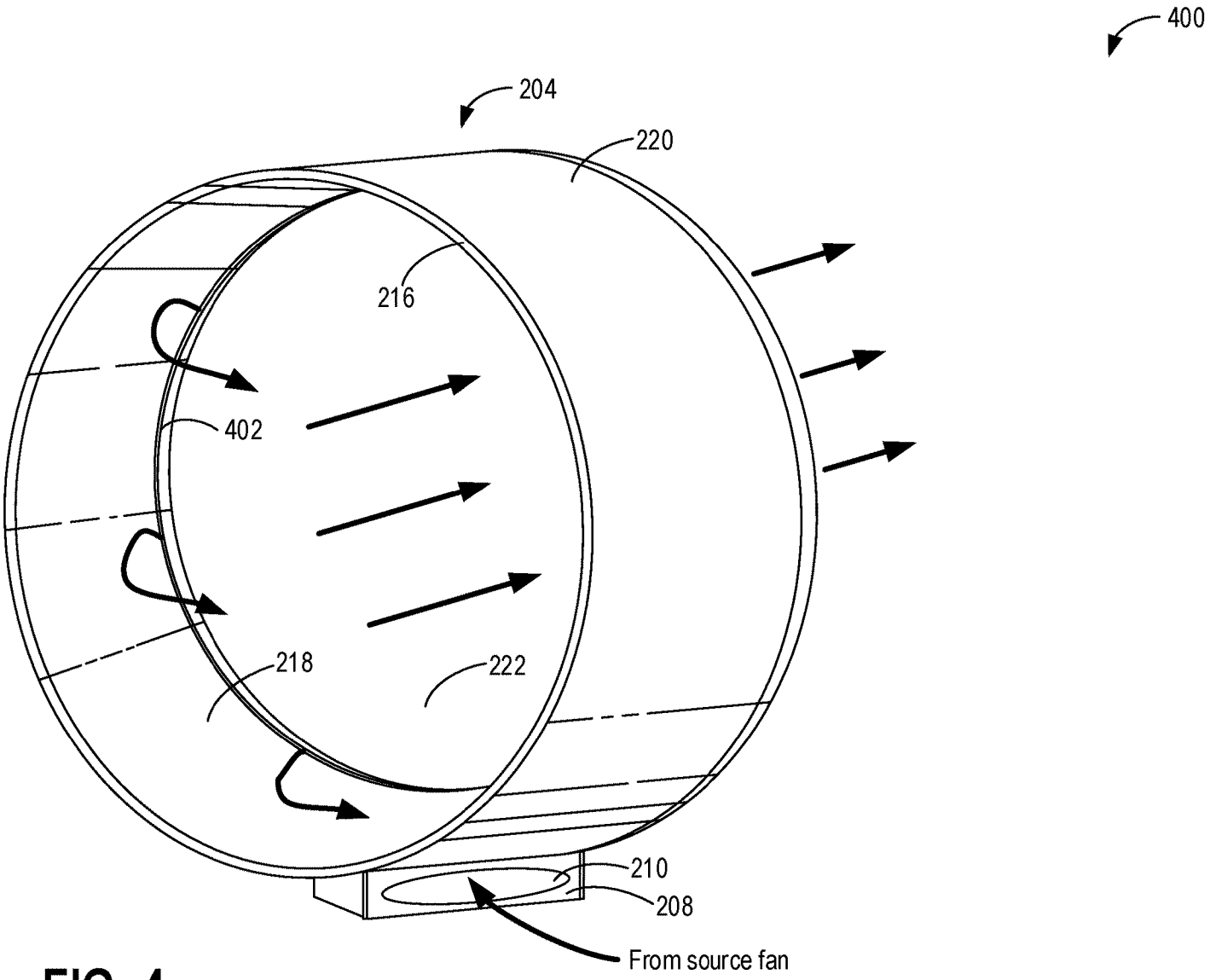
FIG. 4 depicts one entrainment disc of a bladeless fan, according to the present disclosure.
Figure 7:
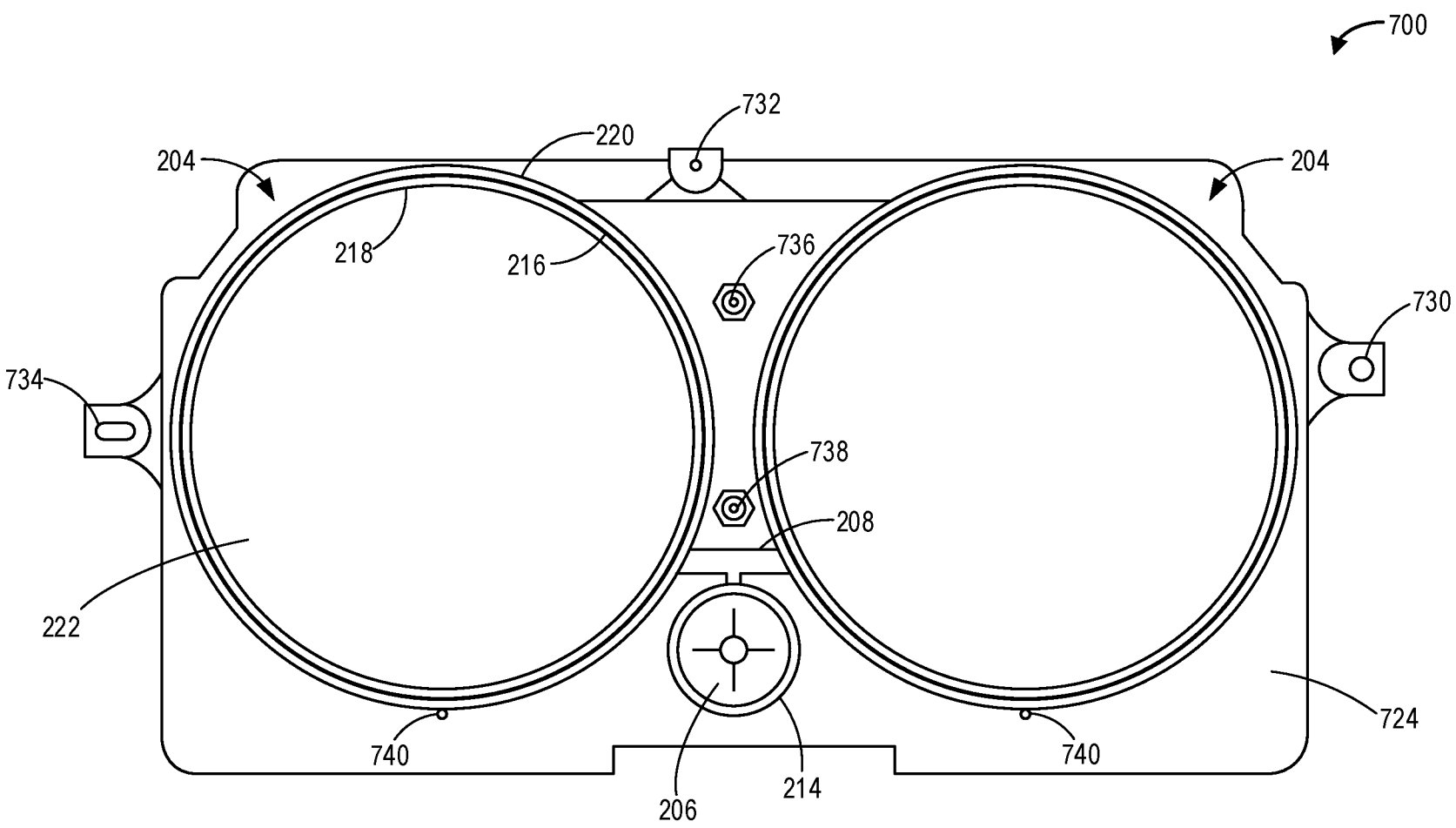
FIG. 7 shows a view of the bladeless cooling fan looking from the engine.
Figure 8:
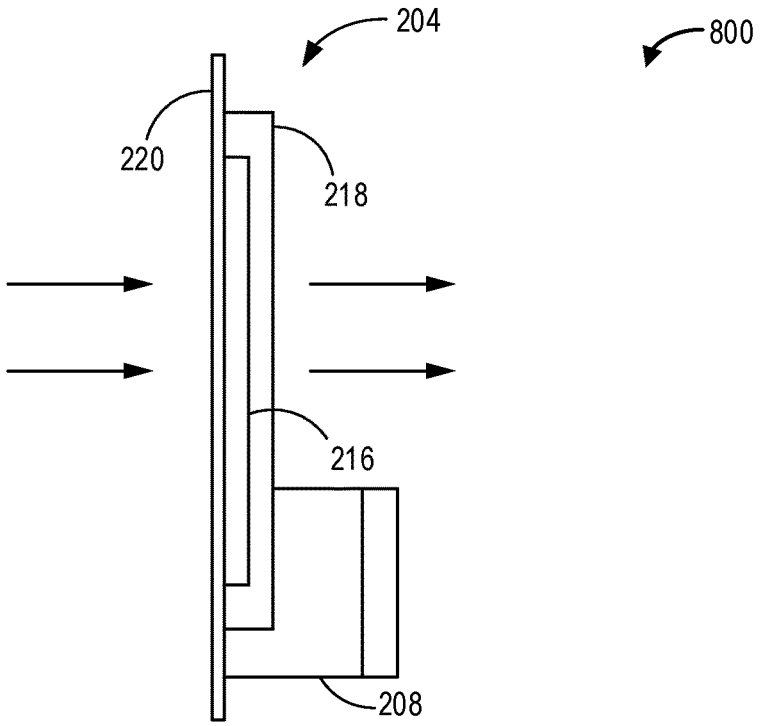
FIG. 8 shows a side view of the bladeless cooling fan.
Figure 9:
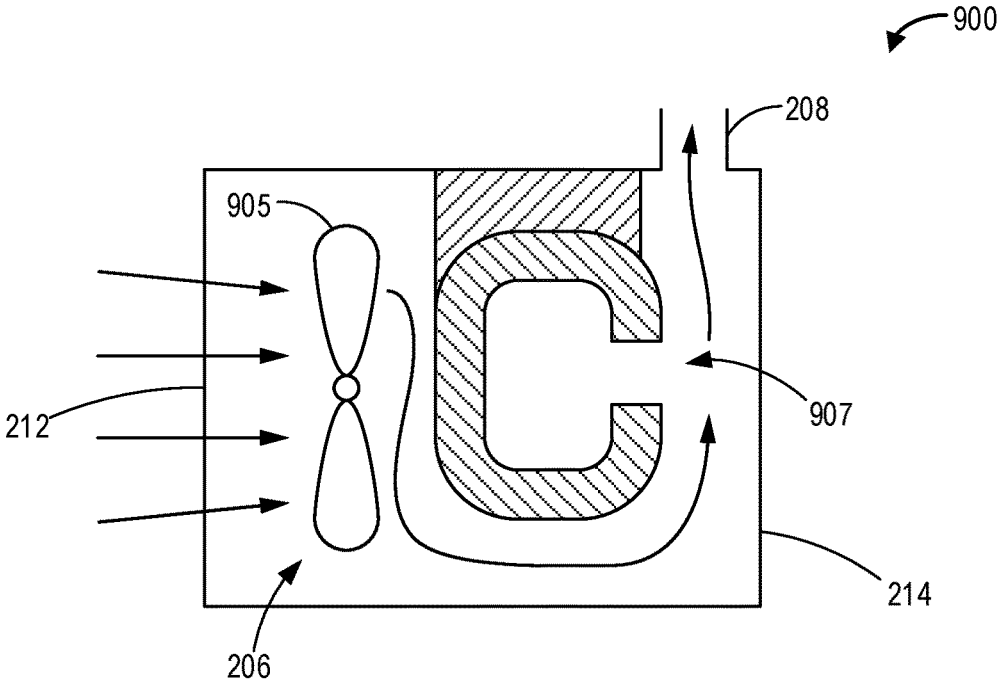
FIG. 9 shows a view of the source fan and resonator inside the housing.

The following description relates to a bladeless cooling fan for a vehicle cooling system, such as the cooling system of FIG. 1. Example configurations for a bladeless cooling fan having a source fan coupled to a Helmholtz resonator are shown in FIGS. 2-3. Various views of the fan are shown in FIGS. 7-9. An example entrainment disc is shown in FIG. 4. A controller may be configured to perform a routine, such as the example routine of FIG. 5, to operate the cooling fan in accordance with various vehicle cooling demands. For example, the cooling fan may be activated at lower vehicle speeds and deactivated at higher vehicle speeds, such as illustrated in the example graph of FIG. 10. In this way, the cooling fan provides improvements over cooling fans in the prior art, such as the fan shown in FIG. 6 and described below.

FIG. 1 is a schematic depiction of an example embodiment of a vehicle cooling system 100 in a motor vehicle 102. Vehicle 102 has wheels 106, a passenger compartment 104, and an under-hood compartment 103. Under-hood compartment 103 may house various under-hood components under the hood (not shown) of motor vehicle 102. For example, under-hood compartment 103 may house an internal combustion engine 10. Internal combustion engine 10 has a combustion chamber that may receive intake air via an intake passage 44 and may exhaust combustion gases via an exhaust passage 48. In one example, intake passage 44 may be configured as a ram-air intake, wherein the dynamic pressure created by moving vehicle 102 may be used to increase a static air pressure inside the engine's intake manifold. As such, this may allow a greater mass flow of air through the engine, thereby increasing engine power. Engine 10 as illustrated and described herein may be included in a vehicle such as a road automobile, among other types of vehicles. While the example applications of engine 10 will be described with reference to a vehicle, it should be appreciated that various types of engines and vehicle propulsion systems may be used, including passenger cars, trucks, etc.

In some examples, vehicle 102 may be a hybrid electric vehicle (HEV) with multiple sources of torque available to one or more of wheels 106. In other examples, vehicle 102 is a conventional vehicle with only an engine or an electric vehicle with only an electric machine(s). In the example shown, vehicle 102 includes engine 10 and an electric machine 52. Electric machine 52 may be a motor or a motor/generator. A crankshaft (not shown) of engine 10 and electric machine 52 are connected via transmission 54 to vehicle wheels 106 when one or more clutches 56 are engaged. In the depicted example, a first clutch 56 is provided between engine 10 (e.g., between the crankshaft of engine 10) and electric machine 52, and a second clutch 56 is provided between electric machine 52 and transmission 54. A controller 12 may send a signal to an actuator of each clutch 56 to engage or disengage the clutch, so as to connect or disconnect the crankshaft from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 106. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 72.

Alternator 72 may be configured to charge system battery 58 using engine torque via the crankshaft during engine running. In addition, alternator 72 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 72 in order to regulate the power output of the alternator based upon system usage requirements, including auxiliary system demands.

Under-hood compartment 103 may further include a cooling system 100, which circulates coolant through internal combustion engine 10 to absorb waste heat and distributes the heated coolant to a radiator 80 and/or a heater core 55 via coolant lines 82 and 84, respectively. In one example, as depicted, cooling system 100 may be coupled to engine 10 and may circulate engine coolant from engine 10 to radiator 80 via an engine-driven water pump 86 and back to engine 10 via coolant line 82. Engine-driven water pump 86 may be coupled to the engine via a front end accessory drive (FEAD) 36 and rotated proportionally to engine speed via a belt, chain, etc. Specifically, engine-driven pump 86 may circulate coolant through passages in the engine block, head, etc., to absorb engine heat, which is then transferred via radiator 80 to ambient air. In one example, where engine-driven water pump 86 is a centrifugal pump, the pressure (and resulting flow) produced by the pump may be proportional to the crankshaft speed, which in the example of FIG. 1, may be directly proportional to the engine speed. The temperature of the coolant may be regulated by a thermostat valve 38, located in cooling line 82, which may be kept closed until the coolant reaches a threshold temperature.

Coolant may flow through coolant line 82, as described above, and/or through coolant line 84 to heater core 55 where the heat may be transferred to passenger compartment 104 before the coolant flows back to engine 10. Coolant may additionally flow through a coolant line 81 and through one or more of electric machine (e.g., motor) 52 and system battery 58 to absorb heat from the one or more of electric machine 52 and system battery 58, particularly when vehicle 102 is a HEV or an electric vehicle. In some examples, engine-driven water pump 86 may operate to circulate the coolant through each of coolant lines 81, 82, and 84.

One or more blowers (not shown) and cooling fans may be included in cooling system 100 to provide airflow assistance and augment a cooling airflow through the under-hood components. For example, cooling fans 91 and 95, coupled to radiator 80, may be operated when the vehicle is moving and the engine is running to provide cooling airflow assistance through radiator 80. The cooling fans may be coupled behind radiator 80 (when looking from a grille 112 toward engine 10). In one example, as elaborated with reference to FIGS. 2-3 and 7, cooling fans 91 and 95 may be configured as bladeless cooling fans. That is, the cooling fans may be configured to emit airflow without the use of blades or vanes, thereby creating an airflow output area that is absent of vanes or blades, as shown with reference to FIG. 4. Cooling fans 91 and 95 may draw a cooling airflow into under-hood compartment 103 through an opening in the front-end of vehicle 102, for example, through grille 112. Such a cooling airflow may then be utilized by radiator 80 and other under-hood components (e.g., fuel system components, batteries, etc.) to keep the engine and/or transmission cool. Further, the airflow may be used to reject heat from a vehicle air conditioning system. Further still, the airflow may be used to increase the performance of a turbocharged/supercharged engine that is equipped with intercoolers that reduce the temperature of the air that goes into an intake manifold of the engine. While this embodiment depicts two cooling fans, other examples may use only a single cooling fan.

Cooling fans 91 and 95 may be coupled to battery-driven motors 93 and 97, respectively. Motors 93 and 97 may be driven using power drawn from system battery 58. In one example, system battery 58 may be charged using electrical energy generated during engine operation via alternator 72. For example, during engine operation, engine generated torque (in excess of what is required for vehicle propulsion) may be transmitted to alternator 72 along a drive shaft (not shown), which may then be used by alternator 72 to generate electrical power, which may be stored in an electrical energy storage device, such as system battery 58. System battery 58 may then be used to activate battery-driven (e.g., electric)

fan motors 93 and 97. As elaborated with reference to FIGS. 2-3, by including a Helmholtz resonator next to a source fan of the cooling fans, the efficiency of the fan can be increased, enabling a given output of the cooling fan to be provided using a lower power electrical motor. This reduces the electric consumption of the fan and increases overall vehicle fuel economy. Further, the Helmholtz resonator decreases fan noise, decreasing the overall noise, vibration, and harshness (NVH) of vehicle 102. In other examples, the cooling fan may be operated by enabling a variable speed electric motor coupled to the cooling fan. In still other examples, cooling fans 91 and 95 may be mechanically coupled to engine 10 via a clutch (not shown), and operating the cooling fans may include mechanically powering their rotation from engine rotational output via the clutch.

Under-hood compartment 103 may further include an air conditioning (AC) system comprising a condenser 88, a compressor 87, a receiver drier 83, an expansion valve 89, and an evaporator 85 coupled to a blower (not shown). Compressor 87 may be coupled to engine 10 via FEAD 36 and an electromagnetic clutch 76 (also known as compressor clutch 76), which allows the compressor to engage or disengage from the engine based on when the air conditioning system is turned on and switched off. Compressor 87 may pump pressurized refrigerant to condenser 88, mounted at the front of the vehicle. Condenser 88 may be cooled by cooling fans 91 and 95, thereby, cooling the refrigerant as it flows through. The high pressure refrigerant exiting condenser 88 may flow through receiver drier 83 where any moisture in the refrigerant may be removed by the use of desiccants. Expansion valve 89 may then depressurize the refrigerant and allow it to expand before it enters evaporator 85 where it may be vaporized into gaseous form as passenger compartment 104 is cooled. Evaporator 85 may be coupled to a blower fan operated by a motor (not shown), which may be actuated by system voltage.

System voltage may also be used to operate an entertainment system (radio, speakers, etc.), electrical heaters, windshield wiper motors, a rear window defrosting system, and headlights, amongst other systems.

FIG. 1 further shows a control system 14. Control system 14 may be communicatively coupled to various components of engine 10 to carry out the control routines and actions described herein. For example, as shown in FIG. 1, control system 14 may include controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, engine temperature, ambient temperature, intake air temperature, etc.), cooling system sensors (such as coolant temperature, fan speed, passenger compartment temperature, ambient humidity, etc.), and others (such as Hall Effect current sensors from the alternator and battery, a system voltage regulator, etc.). Further, controller 12 may communicate with various actuators 18, which may include engine actuators (such as fuel injectors, an electronically controlled intake air throttle plate, spark plugs, etc.), cooling system actuators (such as motor actuators, motor circuit relays, etc.), and others. As an example, controller 12 may send a signal to an actuator of clutch 56 to engage or disengage the clutch, so as to connect or disconnect the crankshaft of engine 10 from transmission 54 and the components connected thereto. In some examples, the storage medium may be programmed with computer readable data representing instructions executable by the processor for performing the methods described below as well as other variants that are anticipated but not specifically listed.

Controller 12 may adjust the operation of cooling fans 91 and 95 based on vehicle cooling demands, vehicle operating conditions, and in coordination with engine operation. In one example, during a first vehicle moving condition, when the engine is operating and vehicle cooling and airflow assistance from the fan is desired, cooling fans 91 and 95 may be powered by enabling battery-driven motors 93 and 97 to provide airflow assistance in cooling under-hood components. The first vehicle moving condition may include, for example, an engine temperature or coolant temperature that is above a threshold temperature. The threshold temperature may refer to a non-zero, positive temperature value above which airflow assistance is provided for engine cooling in order to avoid engine overheating, for example. In another example, during a second vehicle moving condition, when airflow assistance is not desired (for example, due to sufficient vehicle motion-generated airflow through the under-hood compartment), fan operation may be discontinued by disabling the fan motor.

Turning now to FIG. 2, an angled view of an example embodiment of a bladeless cooling fan system 200 is shown that may be used as part of a vehicle cooling system, such as cooling system 100 of FIG. 1. In one example, cooling fan system 200 depicts one or both of cooling fans 91 and 95 of FIG. 1. Cooling fan system 200 is configured to generate an air current and a cooling effect without exposed blades or vanes included in the fan. As elaborated herein, the fan relies on the presence of a curved Coanda surface, which provides a region for amplifying a cooling airflow by leveraging the Coanda effect. As is known in the art, a Coanda surface is a surface over which fluid flow exiting an output orifice close to the surface exhibits the Coanda effect. Therein, a fluid tends to flow over the Coanda surface (e.g., a convex surface) clinging to, or hugging, the surface. As a result, an entrainment of the airflow occurs, which allows for airflow amplification.

Cooling fan system 200 includes a plurality of entrainment (or induction) discs 204 arranged behind a radiator 202 (as seen from the engine). In the depicted example, the cooling fan system 200 includes four entrainment discs 204. The plurality of entrainment discs are arranged in a planar configuration to be parallel to a plane of a substantially square radiator 202 positioned therebehind. FIG. 2 shows circular entrainment discs 204 and a fan enclosure from a view offset angle of 30 degrees from the plane of the engine. Each entrainment disc 204 is annular in shape and defines a central opening (or cavity) 222. In addition, each disc is covered by an outer wall 220. A more detailed view of a single entrainment disc is shown in FIG. 4. Further, each of the entrainment discs 204 may be surrounded by a shroud (not shown in FIG. 2), as will be further described with respect to FIG. 7. The disc design provides several advantages over traditional bladed fans, such as the example fan of FIG. 6, in that it lends itself for non-circular shapes, including ovals.

Each of the entrainment discs 204 receives a primary airflow via an airflow passage 208 from operation of a source fan 206 located inside a housing 214. Housing 214 is located centrally in relation to the plane of the plurality of entrainments discs 204 and in relation to radiator 202. Source fan 206 may be operated via an electric motor, such as a DC brushless motor, and includes an inlet 212. A Helmholtz resonator (not shown in FIG. 2) is also located within (e.g., inside) housing 214. For example, the Helmholtz resonator may be in close proximity to and downstream of source fan 206. As another example, the Helmholtz resonator may be in close proximity to and upstream of source fan 206 between inlet 212 and source fan 206. As still another example, a Helmholtz resonator may be included at both locations. The Helmholtz resonator is coupled to source fan 206 and increases the efficiency of the source fan (by increasing the air pressure), allowing for the use of a lower power electric motor, such as a motor having a power setting of 25 Watts. The increase in air pressure via the addition of the Helmholtz resonator also enables a reduction in noise characteristics of operating the fan, even when operating at a highest flow setting. For example, the Helmholtz resonator may be tuned to specifically mute noise generated from turbulence within housing 214, such as sounds in the range of 1000 Hz. In other words, the Helmholtz resonator acts as a silencer.

Turning briefly to FIG. 9, an internal view 900 of components within housing 214 is shown. As such, components previously introduced in FIG. 2 are numbered the same as and may not be reintroduced. Internal view 900 shows a side view of source fan 206 and a Helmholtz resonator 907 within housing 214. Ambient air enters housing 214 via inlet 212 (e.g., in the direction of the arrows). The air is then directed via source fan 206 around Helmholtz resonator 907 and to airflow passage 208. Notably, unlike traditional bladed radiator fans (such as the example bladed radiator fan shown in FIG. 6), blades 905 of source fan 206 are within housing 214 and are not exposed. Therefore, a service technician may not come into contact with the blades 905 while source fan 206 remains within housing 214.

Returning to FIG. 2, the air from source fan 206 is then directed along airflow passage 208 into a nozzle (or hollow passage) 216 that is defined by an inner wall 218 (toward central opening 222) and outer wall 220 of each entrainment disc 204. Specifically, airflow passage 208 is coupled to an inner cavity of nozzle 216 of each entrainment disc 204 via corresponding outlets 210. As such, a single source fan 206 may provide airflow to a plurality of entrainment discs 204. A Coanda surface is created at nozzle 216, as may be seen via a cross section across the nozzle. In particular, the nozzle may be annular (for example, having a diameter of around 350 mm), having an interior passage formed as a continuous loop or duct within the nozzle. The walls of the nozzle may be arranged in a looped or folded shape such that the inner wall 218 and the outer wall 220 approach one another to create a mouth through which air entering the nozzle can be dispersed into central opening 222. The mouth may include a tapered region that narrows to an outlet that comprises a gap or spacing (e.g., a spacing in the range of 1-5 mm). By adjusting the spacing, the performance characteristics of cooling fan system 200 may be altered.

FIG. 3 shows another example embodiment of a bladeless cooling fan system 300. Components previously introduced are numbered similarly and not reintroduced for the sake of brevity. In the embodiment of FIG. 3, cooling fan system 300 also includes a plurality of entrainment discs 204 (only one of which is labeled) arranged in a planar arrangement behind radiator 302 (as seen from the engine). In particular, a plane created by the plurality of entrainment discs 204 is parallel to a plane of radiator 302. In the depicted example, the cooling fan system 300 includes six entrainment discs 204 arranged parallel to a substantially rectangular radiator 302. Entrainment discs 204 are circular in shape, but oval shaped entrainment discs are also possible.

Like the entrainment discs of FIG. 2, each of the entrainment discs 204 of FIG. 3 receives a primary airflow from the operation of source fan 206 located inside a housing (e.g., housing 214 as shown in FIGS. 2 and 9). In the present example, the source fan is positioned offset to one side of a central axis of the radiator. In alternate examples, the source fan may be centrally positioned, as in the embodiment of FIG. 2.

FIG. 4 shows a detailed view 400 of a single entrainment disc 204. Components previously introduced are numbered similarly and not reintroduced. Airflow generated via a source fan (e.g., source fan 206 of FIGS. 2, 3, and 9) is received in the nozzle 216 of entrainment disc 204 via outlet 210 of airflow passage 208. The airflow (herein referred to as the primary airflow) is entrained within an inner cavity of nozzle 216 of entrainment disc 204. From there, the primary airflow is directed into central cavity 222 upon passing through a mouth 402 of the nozzle. When the primary airflow flows over inner wall 218 (which acts as a Coanda surface), a Coanda effect is generated that causes a secondary airflow to be entrained with the primary airflow. This additional (secondary) entrainment airflow results in an airflow amplification. Airflows are indicated by thicker lines with arrowheads.

FIG. 8 shows a schematic side view 800 of a single entrainment disc 204. Components previously introduced are numbered similarly and not reintroduced. Airflow generated via a source fan (e.g., source fan 206 of FIGS. 2, 3, and 9) is received in the nozzle 216 of entrainment disc 204 via airflow passage 208. Primary airflow from the source fan induces the air behind entrainment disc 204 (e.g., to the left of, as shown in side view 800) to follow and flow through entrainment disc 204. This additional (secondary) inducement airflow results in further airflow amplification. Airflows are indicated by thicker lines with arrowheads.

Figure 6:
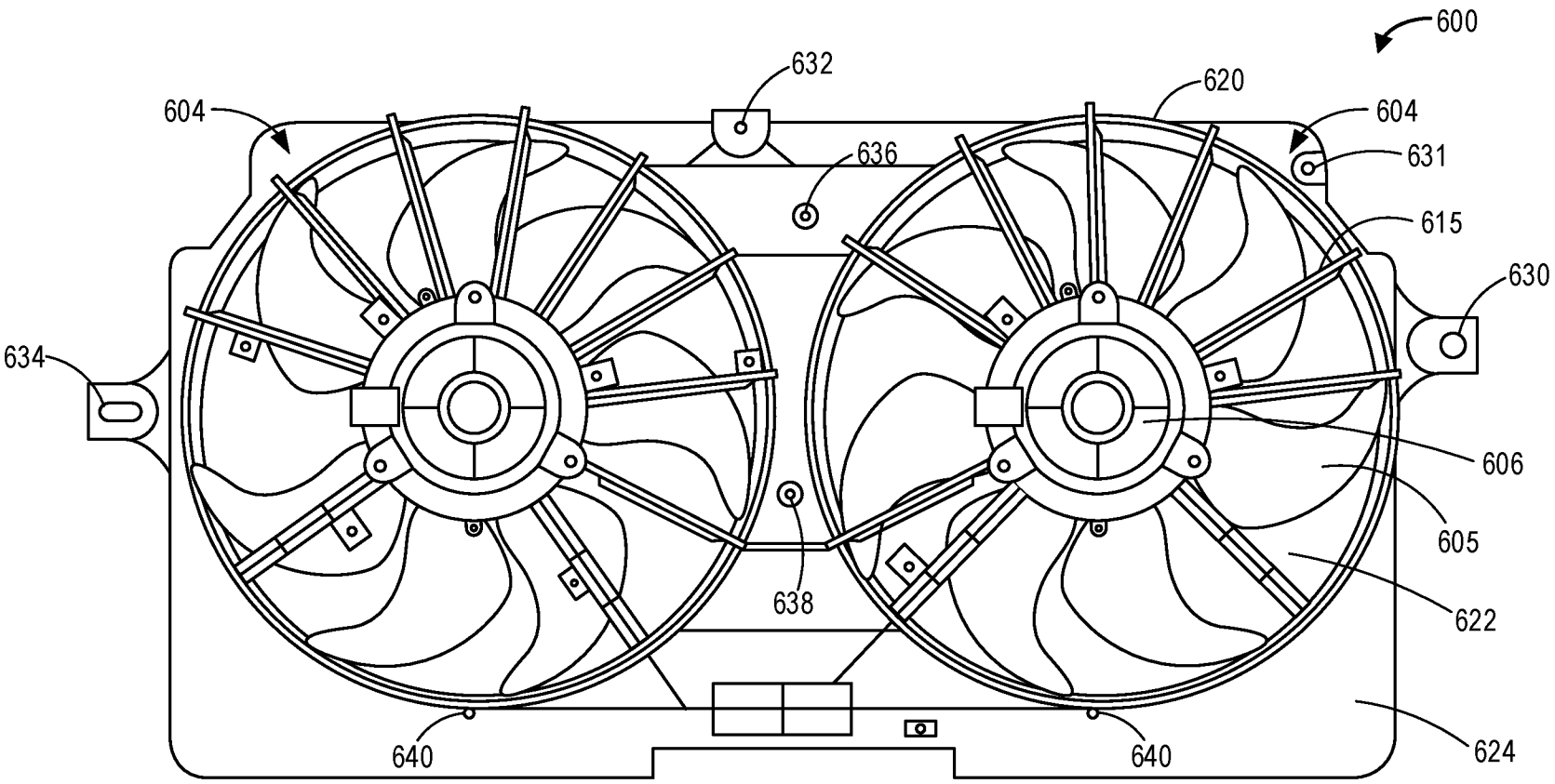
FIG. 6 shows a bladed radiator fan according to the prior art.

Next, FIG. 6 shows an example of a bladed radiator fan 600 according to the prior art, which may be included in an engine cooling system (e.g., cooling system 100 of FIG. 1). Bladed radiator fan 600 is shown from a view of the engine and includes two bladed discs 604, each bladed disc 604 defined by a wall 620 and surrounded by a shroud 624. Each bladed disc 604 includes a plurality of blades 605 driven by an electric motor 606. Airflow generated through rotating blades 605 via electric motor 606 flows through a central cavity 622 of each bladed disc 604. Furthermore, each bladed disc 604 is circular, having a constant diameter, to allow blades 605 to rotate.

As shown in FIG. 6, blades 605 and electric motor 606 may be held in place with respect to wall 620 by a plurality of struts 615. Therefore, blades 605 may rotate within bladed disc 604 without substantially moving vertically or horizontally. Shroud 624, and therefore bladed radiator fan 600, may be attached to a radiator (not shown) via mounting holes 630, 631, 632, 634, 636, and 638. Further, shroud 624 includes two weep holes 640 for water drainage.

In comparison, FIG. 7 shows an example of a bladeless cooling fan 700 according to the present disclosure, which may be included in an engine cooling system (e.g., cooling system 100 of FIG. 1). Components previously introduced are numbered similarly and not reintroduced. Bladeless cooling fan 700 is shown from a view of the engine and includes two entrainment discs 204 surrounded by a shroud 724. In the example of bladeless cooling fan 700, source fan 206 is positioned centrally between the two entrainment discs 204, although in other examples, source fan 206 may be offset to one side of a central axis of shroud 724. Similar to shroud 624 of FIG. 6, shroud 724 includes two weep holes 740 for water drainage and may be attached to a radiator (not shown) via mounting holes 730, 732, 734, 736, and 738. In contrast to central cavity 622 of each bladed disc 604 of FIG. 6, central cavity 222 of each entrainment disc 204 is unobstructed, with no fan blades, struts, or motors blocking airflow through central cavity 222. As a result, airflow through bladeless cooling fan 700 is increased compared with airflow through bladed radiator fan 600 of FIG. 6, even while the fan is not operated. For example, when bladeless cooling fan 700 is included in an under-hood compartment of a vehicle (under-hood compartment 103 of FIG. 1), the fan may not be operated when sufficient motion-related airflow is provided. Thus, bladeless cooling fan 700 may enhance motion-related airflow through the vehicle under-hood compartment compared with bladed radiator fan 600 shown in FIG. 6, reducing drag and increasing heat transfer. As a result, bladeless cooling fan 700 may be operated less frequently, as further described below.

Responsive to a rise in engine or coolant temperature, an engine controller (e.g., controller 12 of FIG. 1) may send a signal to an actuator of the motor coupled to source fan 206 to adjust an airflow output by the source fan. For example, the controller may determine a target level of engine cooling based on the engine temperature. As another example, the controller may determine a target level of transmission, electric machine, and/or system battery cooling based on one or more operating conditions. The controller may then send a signal to an actuator of the motor, the signal corresponding to a duty cycle of the motor that results in a desired airflow (rate, air mass, etc.) that provides the target level of cooling. Additionally, the controller may coordinate the operation of one or more cooling system components to provide the target level of cooling. For example, the controller may coordinate the setting of the source fan motor with settings of grille shutters at a front end of the vehicle (e.g., grille 112 of FIG. 1), coolant pump operation (e.g., engine-driven water pump 86 of FIG. 1), and air conditioning system operation to provide the desired cooling. When the source fan motor is activated, air is drawn into the cooling fan system via the air inlet 212 shown in FIG. 2. The output and emission of the primary airflow creates a low pressure area at the air inlet, which draws additional air into the cooling fan system. The operation of the cooling fan system induces high airflow through nozzle 216 and into central cavity 222. As the primary airflow is directed over the Coanda surface of the nozzle, the airflow and resulting cooling is amplified by the Coanda effect. In addition, a secondary airflow is generated by entrainment of air from the external environment, specifically from the region around the outer edge of the nozzle. A portion of the secondary airflow entrained by the primary airflow may also be guided over the mouth of the nozzle. This secondary airflow combines with the primary airflow to produce a total amplified airflow projected forward from the fan system toward the radiator. As such, the combination of entrainment and amplification results in a total airflow from the bladeless cooling fan system that is greater than the airflow output from a fan assembly without such a Coanda amplification surface adjacent the emission area, or from a fan assembly having fans or blades (e.g., bladed radiator fan 600 of FIG. 6). The amplification and laminar type of airflow produced results in a sustained flow of air being directed toward the engine compartment from the nozzle. This results in an emitted airflow that has a lower velocity but an increased mass flow. Thus, the performance of the cooling fan system is increased while reducing the noise generated by the fan via the Helmholtz resonator.

In addition to operating the cooling fan system for providing a target level of vehicle or engine cooling wherein all the entrainment discs receive the primary airflow from the source fan, the controller may selectively direct airflow from the source fan to selected entrainment discs. For example, based on the location of an entrainment disc relative to other engine compartment and under-hood components, and further based on cooling demands of those components, one or more entrainment discs may receive airflow from the source fan while others do not. As an example, during conditions when cooling of an AC condenser is indicated (such as when AC output is at or near a maximum output), one or more or all of the entrainment discs on a lower row of the cooling fan system may receive airflow given their proximity to the AC condenser.

Figure 5:
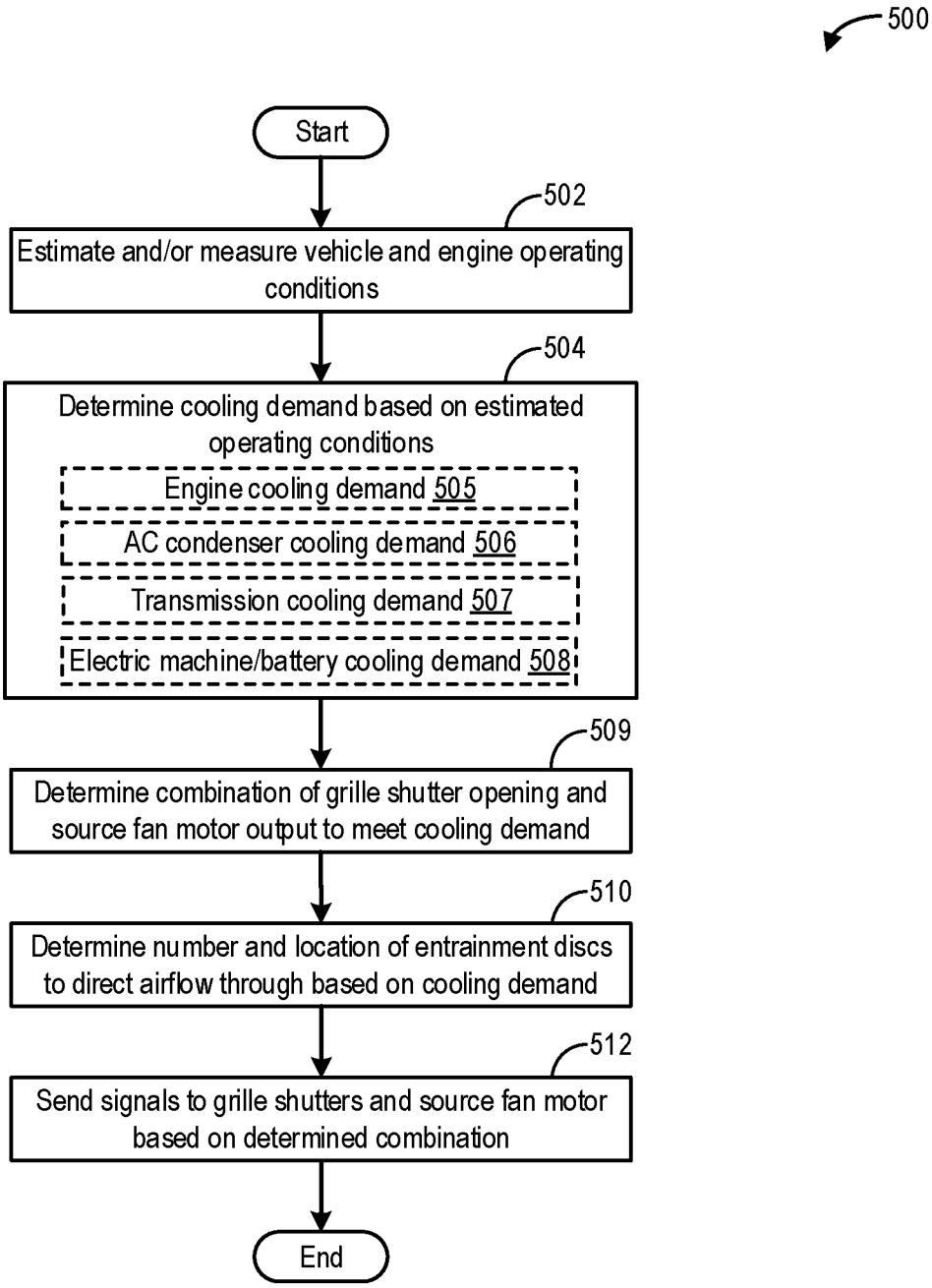
FIG. 5 is an example flowchart illustrating a routine for operating a bladeless cooling fan of a vehicle cooling system.

FIG. 5 shows an example routine 500 that may be executed for operating a vehicle cooling system (e.g., vehicle cooling system 100 of FIG. 1). A controller (e.g., controller 12 of FIG. 1) may determine a desired (e.g., target) level of vehicle cooling and adjust operation of one or more vehicle cooling system components, including a bladeless cooling fan system (e.g., as described with respect to FIGS. 2-4 and 7-9), grille shutters, etc., to provide the desired level of cooling to components of an under-hood compartment. Instructions for carrying out method 500 and the rest of the methods included herein may be executed by the controller based on instructions stored on a memory of the controller and in conjunction with signals received from sensors of the vehicle system, such as the sensors described above with reference to FIG. 1. The controller may employ actuators of the vehicle system to adjust engine and vehicle system operation according to the methods described below.

At 502, the method includes estimating and/or measuring vehicle and engine operating conditions. Operating conditions may include, for example, vehicle speed, engine speed and load, driver torque demand, road conditions (e.g., road grade), weather conditions (e.g., presence of wind, rain, snow, etc.), the settings of grille shutters coupled to the front end of the vehicle, etc. The operating conditions may further include ambient conditions, such as ambient air temperature, pressure, and humidity; engine temperature; coolant temperature; transmission fluid temperature; engine oil temperature; cabin air settings (e.g., AC settings); boost pressure (if the engine is boosted); exhaust gas recirculation (EGR) flow; manifold pressure (MAP); manifold airflow (MAF); manifold air temperature (MAT); etc. When the vehicle is a HEV, operating conditions may further include a mode of operation, such as an engine-only mode (where all of the torque to propel the vehicle is supplied by the engine), an electric-only mode (where all of the torque to propel the vehicle is supplied by an electric machine), and an assist mode (where the torque to propel the vehicle is supplied by both the engine and the electric machine). Operating conditions may further include a temperature of the electric machine and/or a temperature of the system battery. In one example, the operating conditions may be estimated based on inputs from one or more sensors, such as an ACT sensor (for estimating air charge temperature), an ECT sensor (for estimating coolant temperature), a CHT sensor (for estimating a temperature of coolant circulating at the cylinder head), an MCT sensor (for estimating manifold charge temperature), etc. As another example, the temperature of the electric machine may be estimated based on an amount of torque provided by the electric machine, with the controller inputting the amount of torque into a look-up table, algorithm, or map and outputting a corresponding estimated temperature of the electric machine. As still another example, the temperature of the system battery may be estimated based on a current drawn on the system battery, with the controller inputting the current into a look-up table, algorithm, or map and outputting a corresponding estimated temperature of the system battery.

At 504, the method includes determining a vehicle cooling demand based on the estimated operating conditions. The vehicle cooling demand may include an engine cooling demand, as indicated at 505, an AC condenser cooling demand, as indicated at 506, a transmission cooling demand, as indicated at 507, and an electric machine or battery cooling demand, as indicated at 508. For example, the estimated engine temperature may be compared to a first threshold temperature, and if the engine temperature is higher than the first threshold temperature, it may be determined that active engine cooling is desired. For example, the first threshold temperature may be a non-zero, positive value threshold referring to a temperature above which active engine cooling is used to reduce and/or maintain the engine temperature to prevent engine overheating and related degradation. Therefore, the engine cooling demand 505 may be determined as a function of the difference between the estimated engine temperature and the first threshold temperature. As another example, based on an output of the AC condenser, it may be determined if active AC condenser cooling is indicated. The AC condenser cooling demand 506 may be determined as a function of an AC temperature setting selected by a vehicle operator relative to the ambient temperature (and ambient humidity). As a further example, the estimated transmission fluid temperature may be compared to a second threshold temperature, and if the transmission fluid temperature is higher than the second threshold temperature, it may be determined that transmission cooling is indicated. For example, the second threshold temperature may be a non-zero, positive value threshold referring to a temperature above which active transmission cooling is used to reduce and/or maintain the transmission temperature to prevent transmission overheating and related degradation. The second threshold temperature may be the same as or different from the first threshold temperature. Therefore, the transmission cooling demand 507 may be determined as a function of the difference between the estimated transmission fluid temperature and the second threshold temperature. Further, the estimated electric machine temperature or estimated system battery temperature may be compared to a third threshold temperature, and if the estimated electric machine temperature or estimated system battery temperature is greater than the third threshold temperature, it may be determined that electric machine or battery cooling is indicated. For example, the third threshold temperature may be a non-zero, positive value threshold referring to a temperature above which active electric machine or system battery cooling is used to reduce and/or maintain the temperature of the electric machine or the system battery. Similarly, coolant temperature may be compared to a fourth threshold temperature (which may be the same as or different from the first, second, and third threshold temperatures) to determine if coolant cooling is indicated.

At 509, based on the current engine operating conditions and the determined cooling demands, settings for one or more components of the vehicle cooling system may be determined. For example, a combination of settings for grille shutters (or louvers) coupled to the front end of the vehicle and a power output of the source fan of the cooling fan system may be determined. In one example, when the vehicle speed is higher than a threshold speed, at least a portion of the cooling demand may be met by adjusting the grille shutters to increase an opening of the shutters, thereby enabling a larger amount of ambient airflow to be drawn into the under-hood compartment. The threshold speed may be a non-zero speed that refers to a vehicle speed above which a larger amount of airflow is drawn rapidly into the under-hood compartment of the vehicle, and the combined effect of the larger air mass and larger airflow rate provides a significant amount of cooling. As an example, an amount of ram-air entering the under-hood compartment may be estimated based on the vehicle speed and the grille shutter position. For example, the controller may input the vehicle speed and the grille shutter position into a look-up table, algorithm, or map and output the amount of ram-air. Grille shutter opening may also be increased when the ambient temperature is lower and/or in the presence of wind. However, if the vehicle speed is not sufficiently high or if the grille shutters are already fully open (or their opening is otherwise constrained), at least a portion of the cooling demand may not be met using ambient airflow through the under-hood compartment (e.g., ram-air may be lower). A remainder of the cooling demand may then be met by operating the cooling fans of the cooling system (e.g., cooling fans 91 and 95 of FIG. 1). For example, the controller may send a duty cycle signal to the electric motor coupled to the source fan of the cooling fan system to provide the determined portion of the cooling demand, such as by operating the source fan at speed corresponding to the determined portion of the cooling demand. As the proportion of cooling demand to be provided by the cooling fan system increases, the duty cycle signal sent to the motor may be increased.

Figure 10:
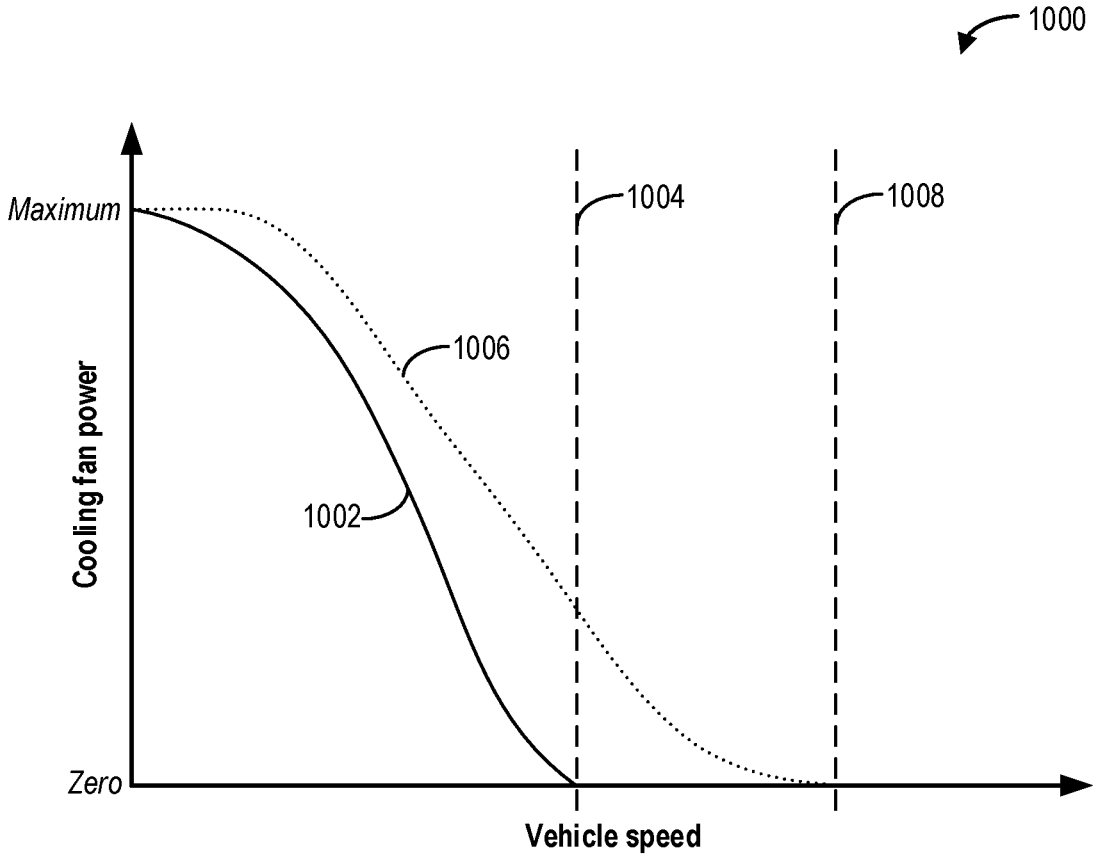
FIG. 10 shows an example graph illustrating a relationship between vehicle speed and cooling fan speed.

Turning briefly to FIG. 10, an example graph 1000 illustrating a relationship between cooling fan power and vehicle speed is shown for operating a bladeless cooling fan system (solid plot 1002). For comparison, a relationship for operating a traditional bladed cooling fan system is also shown (dotted plot 1006). The horizontal axis represents the vehicle speed (e.g., in MPH), with the vehicle speed increasing along the horizontal axis from left to right. The vertical axis represents the cooling fan power, with the power increasing up the vertical axis from zero (e.g., the cooling fan is off) to maximum. For plot 1002, the cooling fan power refers to an operating power of a source fan of the bladeless cooling fan system (e.g., source fan 206 shown in FIGS. 2, 3, 7, and 9). For plot 1006, the cooling fan power refers to an operating power of a bladed disc of the traditional bladed cooling fan system (e.g., bladed disc 604 shown in FIG. 6). Note that a value of the maximum power of the source fan and the bladed disc may be different. Further, an airflow output by the source fan and the bladed disc at each relative cooling fan power may be different.

The example graph 1000 of FIG. 10 represents a constant ambient temperature and grille shutter position. In other examples, the curves may vary based on the ambient temperature and the grille shutter position. For example, as the grille shutters are actuated to a further closed position, the cooling fan power may be increased for a given vehicle speed. Similarly, as the ambient temperature increases, the cooling fan power may be increased for a given vehicle speed. Furthermore, the curves may vary based on an output of an AC condenser, which may be deactivated in the example of FIG. 10.

At lower vehicle speeds, such as vehicle speeds near 0 MPH, a higher proportion of the vehicle cooling demand may be met by the cooling fan (versus ambient airflow). For example, an amount of ram-air is lower at lower vehicle speeds. Thus, the bladeless cooling fan system (plot 1002)

and the traditional bladed cooling fan system (plot 1006) may each be operated at a high (e.g., maximum) fan power to provide high cooling fan airflow output. Because entrainment discs of the bladeless cooling fan system have a larger (e.g., unrestricted) opening than the bladed discs of the traditional bladed cooling fan system, as the vehicle speed increases, the fan power of the bladeless cooling fan system (plot 1002) decreases more quickly than the fan power of the traditional bladed cooling fan system (plot 1006) due to increased ambient airflow through the bladeless cooling fan system providing a higher proportion of the vehicle cooling demand than for the traditional bladed cooling fan.

At higher vehicle speeds, a higher proportion of the vehicle cooling demand may be met by ambient airflow (e.g., through the grille shutters). For example, ram-air is higher at higher vehicle speeds. Therefore, the cooling fan (whether bladeless or bladed, as described further below) may be deactivated, with a cooling fan power of zero, at vehicle speeds above a threshold speed (e.g., as defined above at 508 of FIG. 5). The cooling fan may be activated (e.g., with voltage supplied to a fan motor at a non-zero duty cycle) to operate the cooling fan at a non-zero power once the vehicle speed decreases below the threshold vehicle speed. Because of the larger opening of the entrainment discs of the bladeless cooling fan system compared with the bladed discs of the traditional bladed cooling fan system, a first threshold vehicle speed for activating the bladeless cooling fan system (indicated by dashed line 1004) is lower than a second threshold vehicle speed for activating the traditional bladed cooling fan system (indicated by dashed line 1008). For example, as shown in the example of graph 1000, both of the bladeless cooling fan system (plot 1002) and the traditional bladed cooling fan system (plot 1006) is on (e.g., operating at a non-zero fan power) at vehicle speeds below the first threshold vehicle speed (dashed line 1004), but only the traditional bladed cooling fan system (plot 1006) is on at vehicle speeds above the first threshold vehicle speed. Neither the bladeless cooling fan system nor the traditional bladed cooling fan system is on at vehicle speeds above the second threshold vehicle speed (dashed line 1008). As a result, the bladeless cooling fan system is activated during a smaller vehicle speed region than the traditional bladed cooling fan, leading to less powered cooling fan usage and thus increased fuel economy.

Returning to FIG. 5, at 510, the method includes determining a number and location of entrainment discs through which to direct the cooling airflow based on the cooling demand. For example, when the cooling demand is higher, all of the entrainment discs may receive airflow from the source fan. In another example, when the cooling demand includes an AC condenser cooling demand, the controller may activate the source fan and adjust the output of the motor while directing cooling airflow through only the entrainment discs coupled to a lower row of the cooling fan system (e.g., the lower entrainment discs) since the lower row is closer to the AC condenser. If the engine or transmission radiators do not cover the lower portion of the grille opening, then only the upper entrainment discs may be activated to cool the engine when the AC system is switched off. As illustrated in FIGS. 2 and 3, the entrainment discs may receive airflow from the source fan via an airflow passage (e.g., airflow passage 208). Therefore, as one example, the controller may actuate one or more valves within the airflow passage to direct the airflow from the source fan to the determined number and location of entrainment discs. The one or more valves may be on/off valves, continuously variable valves, or any other type of flow control valve. For example, a valve positioned to restrict airflow to the lower entrainment discs may be fully closed in order to prevent airflow from the source fan to the lower entrainment discs and direct all of the airflow from the source fan to the upper entrainment discs when only cooling via the upper entrainment discs is desired. As another example, the bladeless cooling fan system may include a plurality of source fans, each source fan configured to provide airflow to a subset of the entrainment discs. For example, a first source fan may be included to provide airflow to only the upper entrainment discs via a first airflow passage, and a second source fan may be included to provide airflow to only the lower entrainment discs via a second airflow passage, which is not coupled to the first airflow passage. In such an example, both the first and the second source fans may be activated when cooling airflow is desired through all of the entrainment discs, only the first source fan may be activated when cooling airflow is desired through only the upper entrainment discs, and only the second source fan may be activated when cooling airflow is desired through only the lower entrainment discs. As still another example, airflow through the determined number and location of entrainment discs may be controlled through a combination of one or more valves and a plurality of source fans.

At 512, the method includes sending control signals to the grille shutters and the electric motor of the source fan based on the determined combination (e.g., as determined at 509) in order to provide (the determined portion of) the desired cooling flow through the grille and the cooling fan system, respectively. For example, the controller may send a control signal to the grille shutter system to adjust a degree of opening of the grille shutters and louvers to provide the desired ambient cooling airflow, and the controller may send a different control signal to the motor of the source fan to provide the remaining desired cooling. In one example, during the transition from providing no cooling airflow from the cooling fan to providing cooling airflow via the cooling fan, the control signal sent to the source fan motor may be adjusted so that the fan power gradually changes.

In some examples, each of the entrainment discs of the cooling fan system may be operated differently. For example, in bladeless cooling fan systems having a plurality of entrainment discs, such as the systems depicted at FIGS. 2-3, the settings of a first entrainment disc may be adjusted differently from the settings of a second entrainment disc. This may include enabling or operating the first entrainment disc while disabling or not operating the second entrainment disc. As another example, the first entrainment disc may be operated at a first airflow setting while the second entrainment disc is operated at a second airflow setting that is higher or lower than the first airflow setting. As yet another example, the first entrainment disc may be operated in a first operating window while the second entrainment disc is operated in a second operating window. The entrainment discs may be operated differently by adjusting one or more valves in the airflow passage, supplying airflow to different entrainment discs via different source fans, or a combination thereof, as further described above (e.g., at 510), to adjust (e.g., increase or decrease) the airflow provided to each entrainment disc. The inventors have recognized that the efficiency distribution of each entrainment disc and source fan may be non-linear. The controller may learn an efficiency map for each entrainment disc and source fan based on flow, settings, and distribution of heat around each entrainment disc and source fan. In addition, the efficiency map for entrainment disc and source fan may be based on the presence or absence of components around the entrainment disc or source fan (e.g., the presence of an AC condenser or evaporator releasing heat, or the presence of alternate heat sources or sinks). By adjusting which entrainment disc is operated and at what settings, different parts of the under-hood region may be cooled differently so as to optimize cooling efficiency. As an example, when the air conditioner is operating, based on temperature conditions in the vicinity of each of the entrainment discs and further based on airflow into the source fan, a first fan closer to the AC condenser may be operated at a higher setting while second fan further from the AC condenser may be operated at a lower setting. Following 512, method 500 ends.

In this way, a cooling demand is met without limiting fan operation based on NVH constraints. By using a cooling fan that provides an entrained, bladeless airflow, the NVH characteristics of a cooling fan may be decreased. In addition, a smaller motor may be used to provide the same cooling flow, increasing the efficiency and performance of both the fan as well as the vehicle's fuel economy. By using a fan that has induction discs, coverage of radiator grid edges can be increased as compared to a single circular opening, providing more effective cooling to radiators than a single circular fan. By making the cooling fan bladeless, the radiator area can be reached more easily, without impediments. Further, during conditions when the cooling fans are not operating at higher vehicle speeds, the lack of large fan blades causes less restriction to airflow across the engine, reducing drag and improving heat transfer. Overall, engine cooling is increased with less noise and without degrading fuel economy.

The technical effect of using a bladeless radiator cooling fan is that airflow through the bladeless radiator cooling fan is increased while cooling fan motor usage is decreased, decreasing vehicle noise and increasing vehicle fuel economy.

As one example, a vehicle system for a cooling fan comprises: a plurality of bladeless entrainment discs surrounded by a shroud, the shroud coupled to a radiator and positioned between the radiator and an engine; a hollow central opening within each bladeless entrainment disc that enables unrestricted ambient airflow through the cooling fan; and a source fan for providing airflow to the bladeless entrainment discs, the source fan encased by a housing. In the preceding example, additionally or optionally, each bladeless entrainment disc includes an annular outer wall and an annular inner wall, the annular outer wall and the annular inner wall defining a nozzle through which the airflow provided by the source fan enters the hollow central opening of each bladeless entrainment disc. In any or all of the preceding examples, additionally or optionally, the airflow provided by the source fan enters the housing from atmosphere via an inlet and exits the housing via an airflow passage, the airflow passage having outlets coupled to the nozzle of each of the bladeless entrainment discs. In any or all of the preceding examples, the system additionally or optionally further comprises a Helmholtz resonator proximal to the source fan within the housing. In any or all of the preceding examples, additionally or optionally, the source fan is driven by an electric motor, the electric motor included within the housing. In any or all of the preceding examples, additionally or optionally, an airflow output by the cooling fan is greater than the airflow provided by the source fan. In any or all of the preceding examples, additionally or optionally, the airflow output by the cooling fan is a combination of the airflow provided by the source fan and airflow generated via inducement and entrainment at the plurality of bladeless entrainment discs.

As another example, a cooling system, comprises: a coolant loop for circulating coolant to a motor or battery; and a bladeless fan system including: a source fan for generating an airflow via operation of a lower power motor, the fan and the motor enclosed within a housing; a Helmholtz resonator positioned adjacent to the fan within the housing; a plurality of hollow entrainment discs positioned in a planar arrangement, the entrainment discs coupled to the source fan and configured to receive the airflow from the source fan within an internal cavity of each of the entrainment discs via a nozzle; and a shroud covering a perimeter of each disc. In the preceding example, the system further comprises a radiator, and wherein the bladeless fan system is positioned between the motor or battery and the radiator. In any or all of the preceding examples, additionally or optionally, the planar arrangement of the discs is parallel to a plane of the radiator. In any or all of the preceding examples, additionally or optionally, the nozzle is annular. In any or all of the preceding examples, additionally or optionally, the source fan is coupled to the nozzle of each of the hollow entrainment discs via a passage. In any or all of the preceding examples, additionally or optionally, the motor or battery and the cooling system are included in an under-hood compartment of a vehicle, and the vehicle further comprises: a grille coupled to a front-end of the vehicle for providing ambient airflow to components of the under-hood compartment, the grille including adjustable shutters; and a control system, including a plurality of sensors, a plurality of actuators, and a controller, the controller holding instructions in non-transitory memory that, when executed, cause the controller to: operate the bladeless fan system to provide airflow to components of the under-hood compartment; and adjust the airflow provided by the bladeless fan system based on a cooling demand and an amount of the ambient airflow. In any or all of the preceding examples, additionally or optionally, the cooling demand is determined based on operating conditions measured by the plurality of sensors, and the amount of the ambient airflow is determined based on vehicle speed and a position of the grille shutters. In any or all of the preceding examples, additionally or optionally, adjusting the airflow provided by the bladeless fan system includes adjusting a duty cycle of a signal sent to the lower power motor, with the duty cycle increasing as the amount of the ambient airflow decreases and/or the cooling demand increases.

As another example, a method comprises: determining a cooling demand of components of an under-hood compartment of a vehicle based on a first set of operating conditions; determining a combination of grille shutter opening and airflow generated by a bladeless cooling fan system that will provide the determined cooling demand based on a second set of operating conditions; and adjusting the grille shutter opening and the airflow generated by the bladeless cooling fan system based on the determined combination. In the preceding example, additionally or optionally, the components of the under-hood compartment include an engine, a transmission, and an air conditioning system compressor; the first set of operating conditions include at least one of a temperature of the engine, an output of the air conditioning system compressor, and a temperature of the transmission; and the second set of operating conditions include at least one of a vehicle speed and an ambient temperature. In any or all of the preceding examples, additionally or optionally, the determined combination includes increasing a portion of the determined cooling demand provided by the bladeless cooling fan system when the vehicle speed is lower than a threshold speed and increasing a portion of the determined cooling demand provided by the grille shutter opening when the vehicle speed is at or above the threshold speed. In any or all of the preceding examples, additionally or optionally, adjusting the grille shutter opening and the airflow generated by the bladeless cooling fan system based on the determined combination includes increasing the grille shutter opening and decreasing the airflow generated by the bladeless cooling fan system as the portion of the determined cooling demand provided by the grille shutter opening increases. In any or all of the preceding examples, additionally or optionally, the airflow generated by the bladeless cooling fan system is greater than an airflow output by a source fan of the bladeless cooling fan system, the source fan driven by an electric motor at a fan speed determined based on the determined combination.

In another representation, a system for a vehicle cooling fan comprises: a plurality of bladeless entrainment discs surrounded by a shroud, the shroud coupled to a radiator and positioned between the radiator and an electric machine; a hollow central opening within each bladeless entrainment disc that enables unrestricted ambient airflow through the cooling fan; and a source fan for providing airflow to the bladeless entrainment discs, the source fan encased by a housing. In the preceding example, additionally or optionally, the source fan is driven by an electric motor, the electric motor included within the housing and drawing electric current from a system battery. In any or all of the preceding examples, additionally or optionally, the electric machine draws electric current from the system to provide torque to wheels of the vehicle. In any or all of the preceding examples, additionally or optionally, coolant circulates from the radiator through one or more of the electric machine and the system battery.

In another further representation, a method comprises: determining a cooling demand of components of an under-hood compartment of a hybrid electric vehicle based on a first set of operating conditions; determining a combination of grille shutter opening and airflow generated by a bladeless cooling fan system that will provide the determined cooling demand based on a second set of operating conditions; and adjusting the grille shutter opening and the airflow generated by the bladeless cooling fan system based on the determined combination. In the preceding example, additionally or optionally, the components of the under-hood compartment include an electric machine and a system battery; the first set of operating conditions include at least one of a temperature of the electric machine and a temperature of the system battery; and the second set of operating conditions include at least one of a vehicle speed and an ambient temperature. In any or all of the preceding examples, additionally or optionally, the determined combination includes increasing a portion of the determined cooling demand provided by the bladeless cooling fan system when the vehicle speed is lower than a threshold speed and increasing a portion of the determined cooling demand provided by the grille shutter opening when the vehicle speed is at or above the threshold speed. In any or all of the preceding examples, additionally or optionally, adjusting the grille shutter opening and the airflow generated by the bladeless cooling fan system based on the determined combination includes increasing the grille shutter opening and decreasing the airflow generated by the bladeless cooling fan system as the portion of the determined cooling demand provided by the grille shutter opening increases. In any or all of the preceding examples, additionally or optionally, the airflow generated by the bladeless cooling fan system is greater than an airflow output by a source fan of the bladeless cooling fan system, the source fan driven by an electric motor at a fan speed determined based on the determined combination. In any or all of the preceding examples, additionally or optionally, the system battery supplies electrical energy to one or more of the electric machine and the electric motor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

determining a cooling demand of components of an under-hood compartment of a vehicle based on a first set of operating conditions;

determining a combination of grille shutter opening and airflow generated by a bladeless cooling fan system that will provide the determined cooling demand based on a second set of operating conditions; and adjusting the grille shutter opening and the airflow generated by the bladeless cooling fan system based on the determined combination, wherein the airflow generated by the bladeless cooling fan system is greater than an airflow output by a source fan of the bladeless cooling fan system that is driven by an electric motor at a fan speed determined based on the determined combination, the source fan and the electric motor enclosed in a housing with a Helmholtz resonator positioned adjacent to the source fan within the housing.

2. The method of claim 1, wherein:

the components of the under-hood compartment include an engine, a transmission, and an air conditioning system compressor;

the first set of operating conditions include at least one of a temperature of the engine, an output of the air conditioning system compressor, and a temperature of the transmission;

the second set of operating conditions include at least one of a vehicle speed and an ambient temperature; and the bladeless cooling fan system comprises a plurality of bladeless entrainment discs, each bladeless entrainment disc including a hollow central opening, and wherein the plurality of bladeless entrainment discs are surrounded by a shroud coupled to a radiator.

3. The method of claim 2, wherein the determined combination includes increasing a portion of the determined cooling demand provided by the bladeless cooling fan system when the vehicle speed is lower than a threshold speed and increasing a portion of the determined cooling demand provided by the grille shutter opening when the vehicle speed is at or above the threshold speed.

4. The method of claim 3, wherein adjusting the grille shutter opening and the airflow generated by the bladeless cooling fan system based on the determined combination includes increasing the grille shutter opening and decreasing the airflow generated by the bladeless cooling fan system as the portion of the determined cooling demand provided by the grille shutter opening increases.

* * * * *